US010100984B2

(12) United States Patent
Dubuc et al.

(10) Patent No.: US 10,100,984 B2
(45) Date of Patent: Oct. 16, 2018

(54) INDIRECT LIGHT MIXING LED MODULE FOR POINT-SOURCE APPLICATIONS

(71) Applicant: GE Lighting Solutions, LLC, East Cleveland, OH (US)

(72) Inventors: Eden Dubuc, Lachine (CA); Luigi Tavernese, Lachine (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 168 days.

(21) Appl. No.: 14/883,700

(22) Filed: Oct. 15, 2015

(65) Prior Publication Data

US 2017/0108178 A1 Apr. 20, 2017

(51) Int. Cl.

| | |
|---|---|
| ***F21V 9/00*** | (2018.01) |
| ***F21K 99/00*** | (2016.01) |
| ***F21V 7/00*** | (2006.01) |
| ***F21V 7/04*** | (2006.01) |
| *F21Y 101/02* | (2006.01) |
| *F21Y 105/00* | (2016.01) |
| *F21Y 113/00* | (2016.01) |

(52) U.S. Cl.

CPC ..... *F21K 9/54* (2013.01); *F21V 7/0008* (2013.01); *F21V 7/045* (2013.01); *F21Y 2101/02* (2013.01); *F21Y 2105/003* (2013.01); *F21Y 2113/005* (2013.01)

(58) Field of Classification Search

CPC ..... F21K 9/54; F21V 7/0008; F21V 7/045
USPC ..... 362/231
See application file for complete search history.

(56) References Cited

U.S. PATENT DOCUMENTS

| | | | | |
|---|---|---|---|---|
| 6,149,283 | A | 11/2000 | Conway et al. | |
| 6,238,073 | B1 | 5/2001 | Ito et al. | |
| 6,280,054 | B1 * | 8/2001 | Cassarly | G02B 27/0172 361/240 |

(Continued)

FOREIGN PATENT DOCUMENTS

| | | | |
|---|---|---|---|
| EP | 1857729 | A1 | 11/2007 |
| EP | 2320128 | A2 | 5/2011 |

(Continued)

OTHER PUBLICATIONS

European Search Report and Opinion issued in connection with corresponding EP Application No. 16193689.3 dated Dec. 13, 2016.

(Continued)

*Primary Examiner* — Bryon T Gyllstrom
(74) *Attorney, Agent, or Firm* — Peter DiMauro; GE Global Patent Operation

(57) ABSTRACT

An system including a housing defining an enclosure and having an aperture in an exterior surface of the housing; a concave reflector, the reflector being disposed on or in the enclosure of the housing to reflect light emissions; a plurality of solid state light sources disposed within the housing to direct light emissions within the enclosure towards the reflector, the plurality of solid state light sources including multiple groups of solid state light sources; and a mixing chamber defined by a space within the enclosure located between the reflector and the aperture, wherein the reflector is configured to reflect light emissions from the plurality of solid state light sources towards the mixing chamber where the reflected light emissions are to combine before exiting the housing through the aperture.

19 Claims, 6 Drawing Sheets

(56) References Cited

U.S. PATENT DOCUMENTS

| | | | | |
|---|---|---|---|---|
| 6,682,211 | B2 * | 1/2004 | English | B60Q 1/2696 362/545 |
| 6,840,652 | B1 | 1/2005 | Hymer | |
| 6,995,355 | B2 * | 2/2006 | Rains, Jr. | F21S 2/00 250/228 |
| 7,145,125 | B2 * | 12/2006 | May | G01J 3/0254 250/228 |
| 7,246,921 | B2 | 7/2007 | Jacobson et al. | |
| 7,520,636 | B2 | 4/2009 | Van Der Poel | |
| 7,980,728 | B2 * | 7/2011 | Ramer | F21V 7/0008 362/227 |
| 8,172,415 | B2 * | 5/2012 | Wegh | F21S 10/02 362/231 |
| 8,920,009 | B2 | 12/2014 | Park | |
| 2007/0045524 | A1 * | 3/2007 | Rains, Jr. | F21S 2/00 250/228 |
| 2008/0131836 | A1 * | 6/2008 | Rueggeberg | G01J 3/0251 433/29 |
| 2011/0019408 | A1 * | 1/2011 | Jang | F21V 7/0008 362/235 |
| 2012/0039073 | A1 * | 2/2012 | Tong | F21V 7/0008 362/231 |
| 2013/0293379 | A1 * | 11/2013 | Rains, Jr. | G08B 15/00 340/541 |
| 2013/0293877 | A1 | 11/2013 | Ramer et al. | |
| 2014/0055994 | A1 * | 2/2014 | Kang | F21V 7/048 362/235 |

FOREIGN PATENT DOCUMENTS

| | | | |
|---|---|---|---|
| JP | 2007080533 | A | 3/2007 |
| WO | 2012136572 | A1 | 10/2012 |
| WO | 2013072885 | A1 | 5/2013 |

OTHER PUBLICATIONS

Office Action issued in connection with corresponding EP Application No. 16193689.3 dated Mar. 23, 2018.

* cited by examiner

600

INDIRECT LIGHT MIXING LED MODULE FOR POINT-SOURCE APPLICATIONS

BACKGROUND

Lighting fixtures incorporating solid state light sources are known to be able to provide an efficient output of light. However, retrofitting or replacing light fixtures traditionally having incandescent bulbs may be complicated by a desire and/or need to closely replicate the light output of lighting fixtures that include incandescent bulbs. Some scenarios can be complicated by the fact that some solid state light sources do not produce an output that strictly or closely matches an incandescent bulb to be replaced. For example a white light emitting diode (LED) may not generate light with the same optical spectrum as a warm white incandescent bulb.

Solid state light sources such as a light emitting diode (LED) are more efficient than incandescent bulbs and lamps. Therefore, it would be desirable to provide methods and systems for a LED based incandescent replacement module for a lighting fixture that substantially replicates the light output exhibited by a fixture having a traditional incandescent lamp or bulb.

BRIEF DESCRIPTION OF THE DRAWINGS

Features and advantages of some embodiments of the present invention, and the manner in which the same are accomplished, will become more readily apparent upon consideration of the following detailed description of the invention taken in conjunction with the accompanying drawings, wherein.

DETAILED DESCRIPTION

Figure 1:
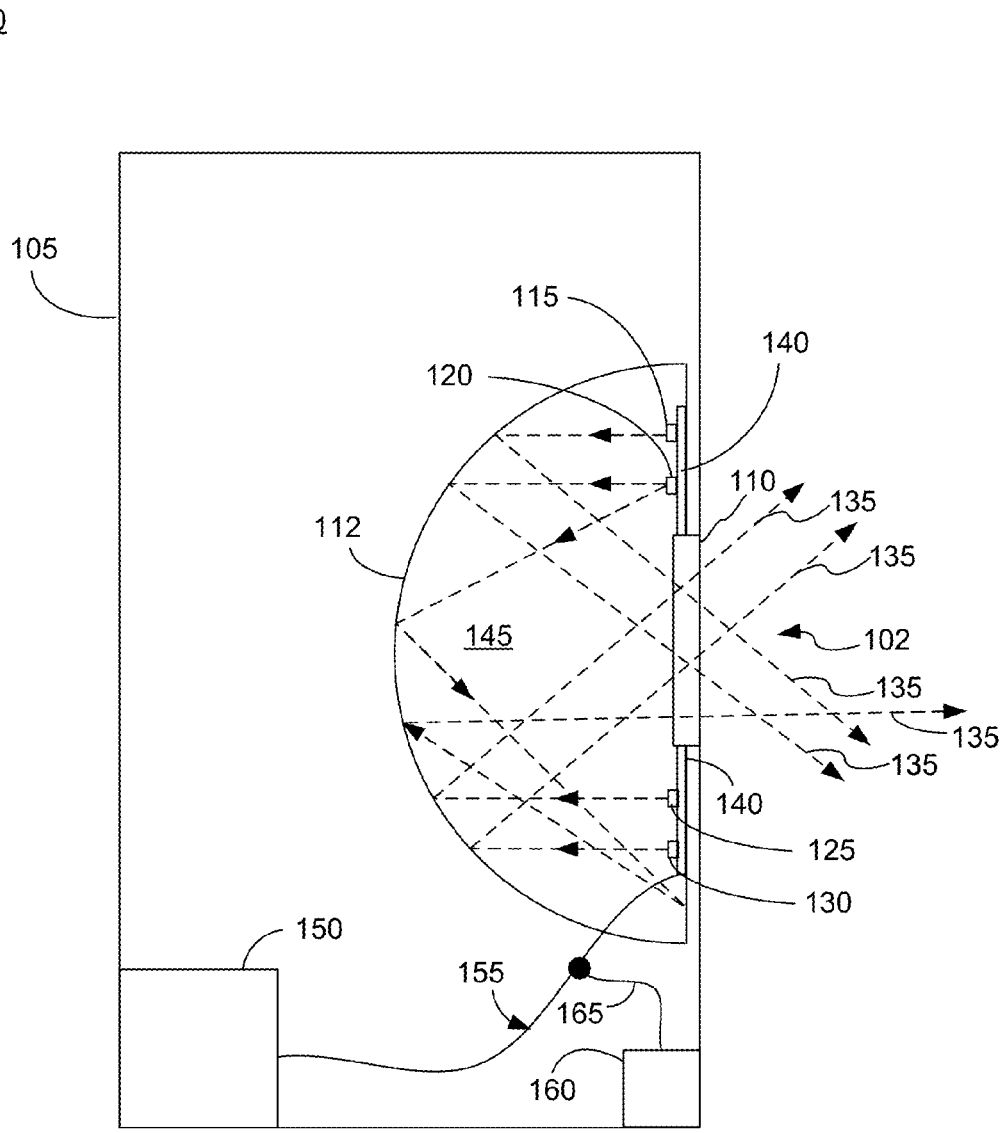
FIG. 1 is an illustrative depiction of a lighting fixture including an internal backlit reflector, in accordance with some aspects herein.

FIG. 1 is an illustrative schematic cross-sectional side view of a lighting fixture 100, in accordance with some embodiments herein. The lighting fixture 100 shown in FIG. 1 may be designated as a replacement for a lighting fixture or module having an incandescent light source. A replacement lighting fixture or module of the present disclosure is also referred to herein as a LED module. LED module 100 may be used in a variety of applications and contexts, including but not limited to replacement of railroad signals, traffic signals, street lights, and other lighting purposes. LED module 100 includes a housing 105 to enclose, at least partially, a number of components of the module. LED module 100 is illustrated as housing a number of different components. It should however be understood that additional, fewer, alternative, and substitute components may also be housed and/or supported by a housing of a LED module herein without any loss of generality.

LED module 100 includes an aperture 102 or opening in an external surface of housing 105. The aperture provides a port or opening through which light generated by light sources within the housing can exit the LED module. In FIG. 1, aperture 102 of LED module 100 is covered by a lens 110. In some embodiments, lens 110 may be constructed of a glass, plastic, or polycarbonate material that can be clear or colored. Lens 110 may be colored to suit a particular purpose or use-case, such as being used as a railroad signal or a traffic signal where the signal device is expected to illuminate, for example, red, green, and yellow at various times throughout the operation of the railroad or traffic signal. Lens 110, in some aspects, substantially fills the aperture in housing 105. In some embodiments, aperture 102 may not have a lens placed therein. That is, in some embodiments, a lighting system herein may not include a lens in the aperture in the housing.

LED module 100 further includes a printed circuit board 140 within the housing that supports a plurality of solid state light sources 115, 120, 125, 130. The plurality of solid state light sources 115, 120, 125, 130 are configured and oriented to emit light towards a backlit reflector 112. Reflector 112 is shaped and positioned within housing 105 to reflect light emitted from solid state light sources 115, 120, 125, 130 through lens 110 that is located in the aperture in housing 105. Reflector 112 may have the shape of a half-sphere (i.e., semispherical) and is referred to herein at various points as a half-sphere backlit reflector, a semispherical backlit reflector, and simply as a reflector, interchangeably. In some aspects, solid state light sources 115, 120, 125, 130 and reflector 112 are configured and arranged relative to each other to reflect light 135 generated by the solid state light sources through lens 110 positioned in the aperture of housing 105. In some embodiments, light emitted from the solid state light sources is reflected by reflector 112 multiple times before it exits housing 105 through aperture 102. In some embodiments, more than fifty percent (50%) of the light emissions from the solid state light sources is reflected by the reflector multiple times before exiting the housing through the housing.

In some embodiments, lighting fixture 100 may include one or more light sources 115, 120, 125, 130. The light sources may be, in some embodiments, solid state light sources such as, for example, light emitting diodes (LEDs). It will be appreciated by those skilled in the art(s) related hereto that light sources other than those specifically shown in the following discussion and corresponding drawings are within the scope of the present disclosure, to the extent that such light sources are compatible with other aspects of the various embodiments herein.

In some aspects, there may be a desire or requirement for the light emitted from LED module 100 and further reflected through lens 110 to replicate or otherwise exhibit the same or similar optical characteristics as a lighting fixture having an incandescent light source. One reason for this desire or requirement may be to efficiently replace legacy incandescent lighting fixtures with replacement lighting fixtures and modules having solid state light sources where users and other observers of the replacements modules will perceive little to no difference in the light output by the replacement modules. In this manner, a replacement lighting module such as, for example, LED module 100 may be installed and placed in operation with little to no perceptible optical difference being noticed by one observing the LED module.

In some embodiments, the LED module may also provide improved reliability and lower operating costs by using solid state light sources.

In some embodiments, housing 105, reflector 112, and lens 110 are configured to define an area or space within the housing between reflector 112 and aperture 102 in the housing, which is covered by lens 110. The space thus defined is referred to herein as a mixing chamber 145. Mixing chamber 145 as configured provides a space within which light emitted from the plurality of solid state light sources 115, 120, 125, 130 interacts and otherwise combines together to yield the resulting light 135 that passes through aperture of housing 105 and lens 110.

In some aspects, mixing chamber 145 is physically and optically isolated from other areas within housing 105. For example, in some embodiments of LED module 100 may have a potting material disposed within at least portions of the housing. The potting material disposed within the housing may comprise a thermally-conductive material that aids in some thermal management aspects of the LED module. Mixing chamber 145 however is physically isolated from including the potting material and other items that could interfere with the light "mixing" that occurs in the mixing chamber when the solid state light sources are operative to emit light towards backlit reflector 112.

In some embodiments, solid state light sources 115, 120, 125, and 130 may comprise a combination of multiple groups of solid state light sources having different colors. In one example, the groups of solid state light sources may include a group of white and a group of colored (i.e., non-white) solid state light sources. For example, solid state light sources 115, 120, 125, and 130 may each be a LED, wherein LED 115 is a white LED emitting white light, LEDs 120 and 125 are blue light emitting LEDs, and LED 130 emits red light. In some embodiments, the combination of white light and non-white light are initially emitted from the solid state light sources 115, 120, 125, 130 towards reflector 112 where light incident upon the inner surface of reflector 112 is reflected about the mixing chamber 145. Other examples include (1) a lighting system including a group of 2700 K (Kelvin) white LEDs and a group of 5500 K white LEDs that combine to produce a white light emission, and (2) a lighting system including a group of red LEDs, a group of green LEDs, and a group of blue LEDs that combine to produce a white light emission. As used herein, a "group" of solid state light sources refers to a set including at least one solid state light source. In some embodiments, the only way for light to escape the mixing chamber is through the aperture in housing 105 that is filled or covered by lens 110.

Prior to exiting the housing via passage through housing aperture 102 and lens 110, the light from the plurality of light source (e.g., solid state light sources 115, 120, 125, and 130) may interact or combine together in the mixing chamber. Furthermore, the combined light may exit the housing by passing through lens 110 in the housing's aperture.

As mentioned earlier, a desire or function of LED module 100 may be to produce a light output having the same or substantially similar light spectrum as a warm white light incandescent lighting fixture. It is noted that the spectral output of a white LED may not match or be sufficiently close to the spectral output of a white incandescent light source. However, the present disclosure provides mechanisms for achieving a desired function of replicating light produced by a white incandescent lighting fixture using solid state light source(s) by combining, in some embodiments, multiple groups of solid state light sources having different colors, where the plurality of solid state light sources additively contribute to each other to produce a light output that is a combination of the plurality of solid state light sources' emissions that can substantially replicate light produced by a white incandescent lighting fixture. In some embodiments, the plurality of solid state light sources' light combines with each other in the mixing chamber in systems and apparatuses herein to produce an output light having a spectral density similar to a white incandescent light source. In some embodiments, the light from the plurality of solid state light sources combines with each other to, in effect, produce a light output having substantially uniform optical characteristics across or over the aperture in the housing when exiting therethrough.

Applicants hereof have realized a LED module that uses one or more (i.e., multiple) solid state light sources such as, for example, a LED. Herein, a solid state light source may include one or more LEDs or chip-on-board (COB) LED arrays that appear white or some other specific, predetermined color. As used herein, an array of single or multiple LEDs that appear white or "substantially white" will be referred to as a "white LED device" for convenience sake and an array of single or multiple LEDs that appear to be colored (e.g., red, yellow, cyan, etc.) will be referred to as a specific color (e.g., red, yellow, cyan, etc.) LED for convenience sake. In accordance with some aspects herein, a solid state light source including an array of warm white or white light LEDs has a color temperature of about less than 2800K. As used herein, the different colors for the multiple groups of solid state light sources herein refers to different values for optical characteristics for the light emitted by the plurality of solid state light sources. For example, the multiple groups of solid state light sources may produce light having wavelengths of different values.

Lens 110 may be clear or colored and is disposed adjacent to an aperture in housing 105 to allow passage of light combined in mixing chamber 145 to exit the housing. In some embodiments, lens 110 is designed to cast a certain color or hue to the light passing therethrough. The particular color may be selected based on a particular application, use or application for LED module 100. In some embodiments, the light that is emitted from solid state light sources 115, 120, 125, 130, reflected from reflector 112, combined in mixing chamber 145, and transmitted through lens 110 effectively and efficiently replicates the spectrum of light transmitted by a conventional incandescent bulb having a color temperature of about less than 2800K and/or a monochromatic LED or other solid state light source product. In some aspects, an area or surface (e.g., a plane) including the aperture is within a surface including the solid state light sources, as shown in FIG. 1.

It is noted that railway wayside signals and other lighting fixtures have traditionally used warm white incandescent bulbs (i.e., a color temperature <2800K) in order to maintain sufficient brightness for red signals. Applicants hereof have recognized that it may be important to perform any LED retrofit of an existing incandescent-illuminated railroad wayside signal (and other types of lighting applications) in such a way that any change in the lighting system or device system does not materially alter or change the expected (in some instances, required) appearance of the signal presented to a train driver, safety personnel, and other relevant observers and entities.

In an effort to efficiently and effectively replicate a railroad wayside signal and other types of lighting fixtures, devices, and systems having an incandescent bulb, the combination of white and non-white solid state light sources selected in some embodiments herein may generally have characteristics that approximate the color temperature and light intensity of an incandescent counterpart railroad wayside signal and other types of lighting fixtures.

Figure 5:
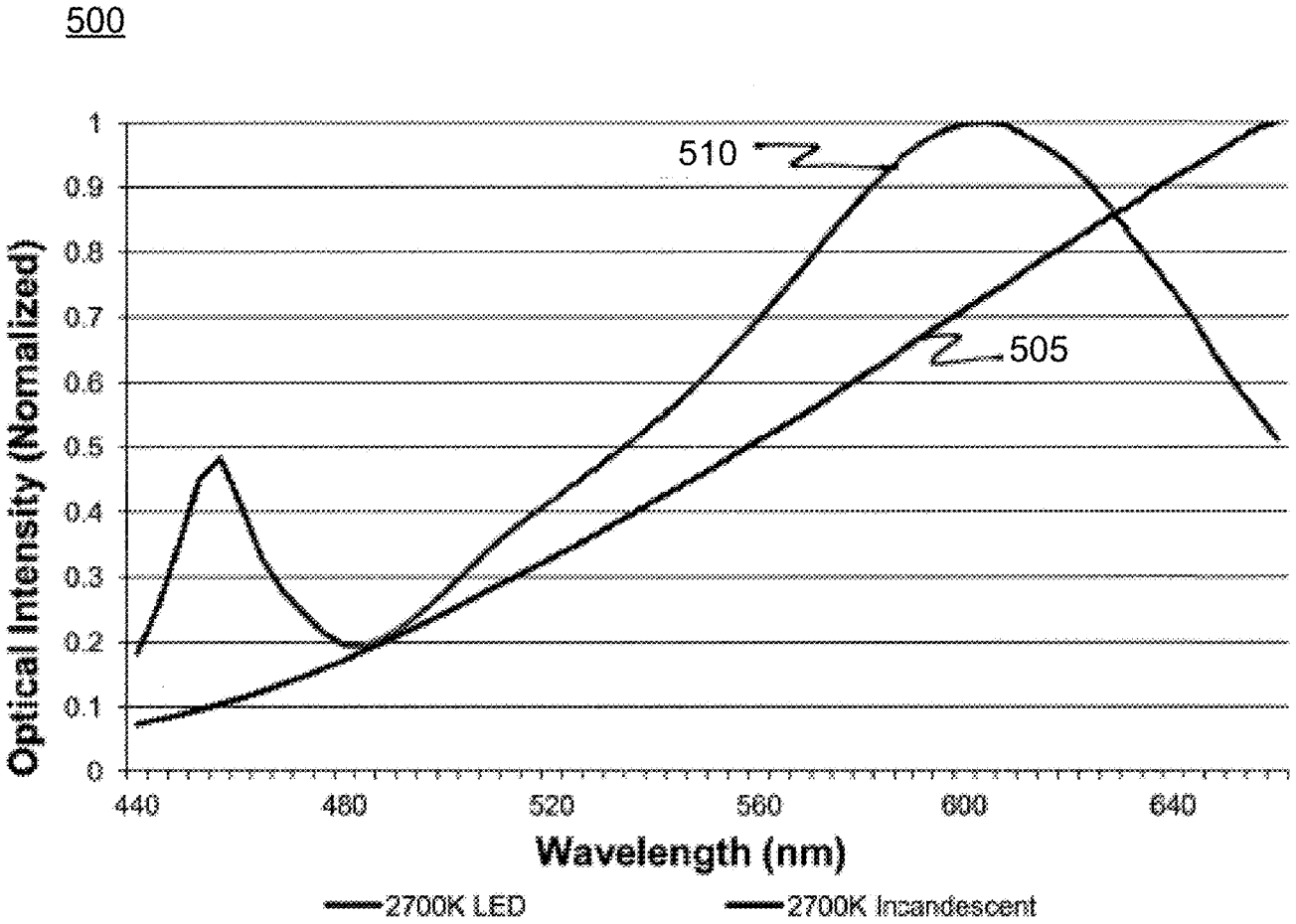
FIG. 5 is a plot of optical intensity spectrum or an incandescent bulb and a LED, according to some embodiments herein.

It is noted that there may be a difference in the radiometric spectrum of light emitted from a warm white incandescent bulb and a white LED device herein with both having a color temperature of about less than 2800K (e.g., about 2700K), even though they may have a similar color temperature and photometric brightness. FIG. 5 is a graph 500 including an illustrative plot 505 of the optical intensity for a 2700K incandescent bulb and an illustrative plot 510 of the optical intensity for a warm white LED (e.g., 2700K) herein. In some aspects as illustrated in graph 500, the incandescent bulb's optical intensity spectrum exhibits an increasing monotonous optical intensity from the shorter wavelength region to the longer wavelength region. However, the white LED device features an optical intensity peak at about 450 nm due to a blue bump, followed by an optical intensity valley at about 480 nm, then the optical intensity thereof increases monotonously until reaching a global peak at about 600 nm, and thereafter the optical intensity decreases monotonously as the wavelength increases.

In some aspects, the non-white solid state light sources herein provide a quantity of light with an intensity and spectrum that can be combined with the white solid state light source herein in a mixing chamber to replicate, in a controlled and repeatable manner, the light generate by an incandescent lighting fixture.

It is noted that in the instance the optical intensity spectrum of white LED devices varies from an incandescent bulb, including bulbs of a similar color temperature, chromaticity of the resultant light transmitted from a LED module disclosed herein may compensate for that variance by combining light from one or more groups of solid state light source(s) with different colors to achieve a required and/or at least desired chromaticity requirement. Applicants hereof have realized that the variance between the optical intensity spectrum of white LED devices and incandescent bulbs can be compensated for by combining light from multiple groups of solid state light sources having different colors in a mixing chamber within the housing of a lighting fixture.

Figure 2:
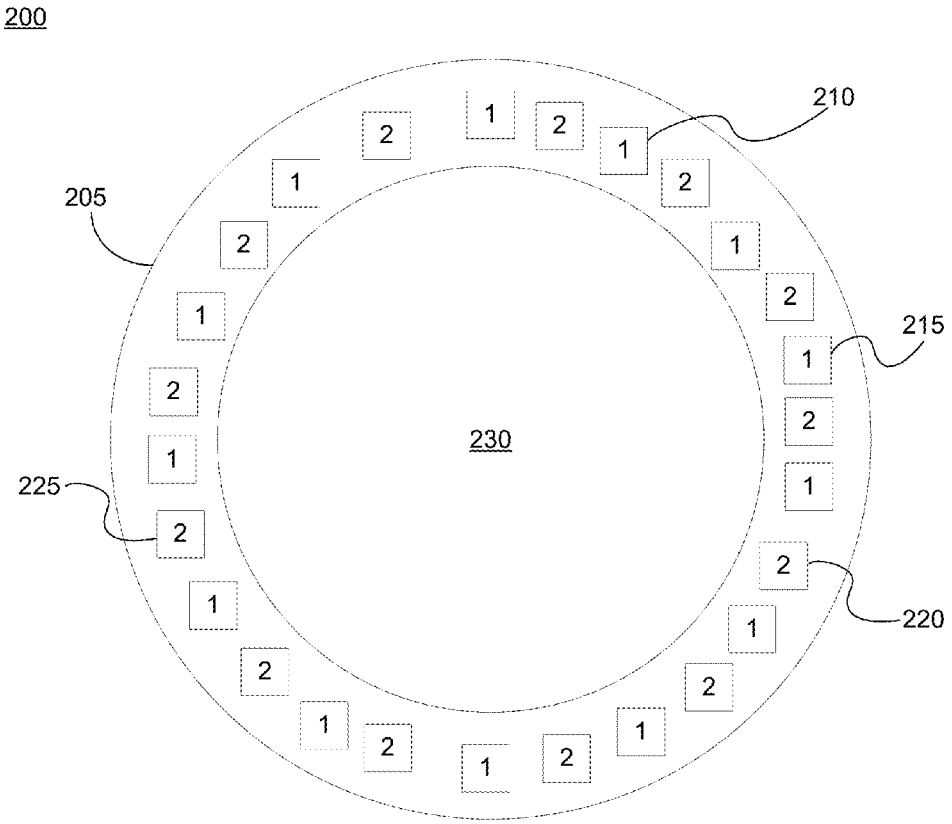
FIG. 2 is illustrative depiction of an annular printed circuit board and an array of solid state light sources supported thereon, in accordance with some aspects herein.

FIG. 2 is an illustrative depiction 200 of an array of solid state light sources that may be included in a LED module such as, but not limited to, module 100 disclosed in FIG. 1. In FIG. 2, the array of light sources comprises an array of LEDs as represented by the specifically referenced LEDs 210, 215, 220, and 225. For sake of clarity, each of the light sources depicted in FIG. 2 is not individually labeled with reference numbers. The array of LEDs shown in FIG. 2 comprises a plurality or multiple groupings of LEDs. As used herein, a group or grouping of solid state light sources (e.g., LEDs) refers to a set of one or more solid state light sources (e.g., LEDs). In the example of FIG. 2, the array of LEDs depicted may be configured into two (i.e., multiple or a plurality of) groups where LEDs belonging to a first group are labeled with a "1" and LEDs belonging to a second group are labeled with a "2" in FIG. 2. For example, LEDs 210 and 215 belong to group "1" and LEDs 220 and 225 belong to group "2". In some embodiments, a light fixture, device, or system herein may include a plurality of groups of solid state light sources where the number of groups is greater than two groups.

The array of LEDs are assembled on a printed circuit board (PCB) 205 that provides a mechanical support and an electrically conductive conduit between the solid state light sources and at least a power supply unit (e.g., FIG. 1, 150). In the embodiment of FIG. 2, PCB 205 has the shape of an annular ring where an opening 220 formed by the annular ring shape of the PCB is sized to correspond with an aperture in the housing that contains the PCB. For example, the size and shape of PCB 200 may correspond to the size and shape of the aperture opening 102 in housing 105 of module 100. In some embodiments, the particular shape and size of PCB 200 may differ from that explicitly shown in FIG. 2 such that they correspond to the size and shape of an aperture opening in the housing of the particular module herein that houses the PCB.

In some embodiments, group "1" and group "2" are operated separately of each other. That is, when the solid state light sources of group "1" are energized and operated to emit light (i.e., "on"), the solid stated light sources of group "2" are not energized or operated to emit light (i.e., the group is "off"). In some embodiments, a first group of solid state light sources (e.g., group "1") may be designated a primary group and be powered by power supply 150, as shown in FIG. 1. A second group of solid state light sources in a lighting fixture may be referred to as a secondary or backup group (e.g., group "2"). In some embodiments, the secondary group may be powered by power supply 150, the same as the primary group of solid state light sources. In some embodiments, the secondary group may be powered to emit light by a secondary or backup power supply such as, for example, power supply 160 that is connected to the light sources by conductor 165. In some embodiments, power supplies 150 and/or 160 may be connected to a mains power system or a battery backup device or system.

In an example use-case, the solid state light sources of group "1" may normally be energized and operated to emit light from lighting fixture 100. However, in the instance that one or more of the solid state light sources fails and/or the mains power system fails, then lighting fixture 100 may switch to powering the solid state light sources of group "2" by battery backup power supply 160. In accordance with some aspects herein, only one of the groups of solid state light sources (i.e., either group "1" or group "2") are operated to emit light therefrom at any given time. In the present example, when one or more of the LEDs of group 1 and/or the power supply 150 fails, then the lighting fixture switches over to energizing the LEDs of group 2 via power supply 160.

In some embodiments, a lighting fixture herein (e.g., 100) including the power supplies 150 and 160 may be configured and functional to provide a signal or indication that a group of solid state light sources therein (e.g., a second group) are being operated by a secondary or backup power supply in response to the lighting fixture switching to power the solid state light sources of a second or alternate group of solid state light sources (e.g., group "2") by a battery backup power supply 160. In this manner, an entity (e.g., administrator, manager, monitoring center/system, etc.) may be notified when a change in operational groups occurs in an effort to, for example, maintain and/or improve device and system reliability, safety, and other considerations.

In accordance with some aspects herein, the combined light emissions exiting the housing 105 through the aperture 102 has the same optical color output for each of the plurality of groups of solid state light sources (e.g., group "1" and group "2"). That is, the appearance of the light emissions from lighting fixture 100 is the same whether produced by the group "1" LEDs or the group "2" LEDs since the optical characteristics for each group is the same. The optical properties of the individual solid state light sources comprising each of the different plurality of groups of solid sate light sources may or may not be the same so long as the combined light emissions exiting the housing 105 through the aperture 102 has the same optical color output for each of the plurality of groups of solid state light sources, in accordance with some embodiments herein.

Figure 3:
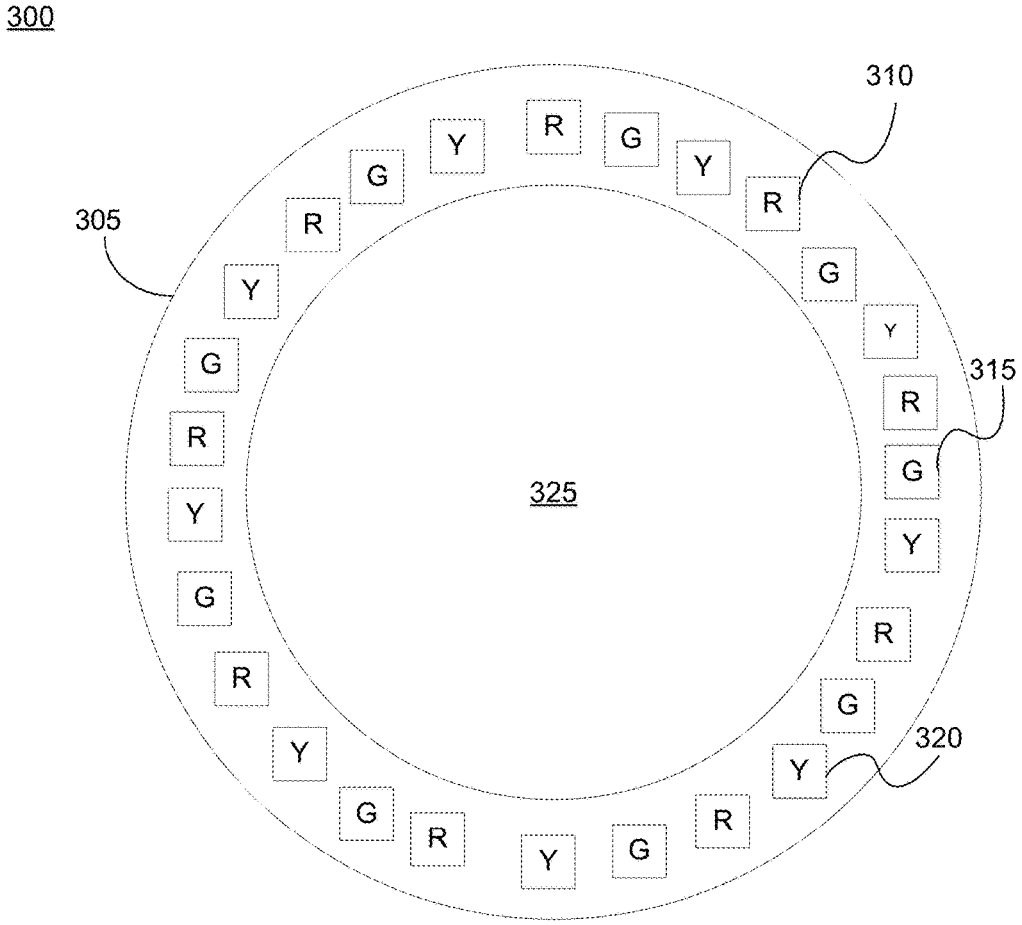
FIG. 3 is an annular printed circuit board and an array of solid state light sources comprising a plurality of groups of solid state light sources supported thereon, in accordance with some aspects herein.

FIG. 3 is an illustrative depiction 300 of an annular printed circuit board and an array of solid state light sources comprising a plurality of groups of solid state light sources supported thereon, in accordance with some aspects herein. The illustrative array of solid state light sources shown in FIG. 3 may be included in a LED module such as, but not limited to, module 100 disclosed in FIG. 1. In FIG. 3, the array of light sources comprises an array of LEDs as represented by the specifically referenced LEDs 310, 315, and 320. For sake of clarity, each of the light sources depicted in FIG. 3 is not individually labeled with reference numbers. The array of LEDs shown in FIG. 3 comprises a plurality or multiple groupings of LEDs. In the example of FIG. 3, the array of LEDs depicted may be configured into three (i.e., multiple or a plurality of) groups where LEDs belonging to a first group are labeled with a "R" where the LEDs in this group emit a red color (e.g. LED 310), LEDs belonging to a second group are labeled with a "G" (e.g. LED 315) since these LEDs emit a green color, and LEDs belonging to a third group are labeled with a "Y" (e.g. LED 320) to indicate that these LEDs emit a yellow color when operated to emit light. Other configurations of groupings of solid state light sources are encompassed within the present disclosure, including groupings varying in number, type, and combination of solid state light sources (e.g., different colors, different types, etc.) other than the specific illustrative examples shown herein.

The array of LEDs of FIG. 3 are assembled on a printed circuit board (PCB) 305 that provides a mechanical support and an electrically conductive conduit 155 between the solid state light sources and at least a power supply unit (e.g., FIG. 1, 150). In the embodiment of FIG. 3, PCB 305 has the shape of an annular ring where an opening 325 formed by the annular ring shape of the PCB is sized to correspond with an aperture in the housing that contains the PCB. For example, the size and shape of PCB 300 may correspond to the size and shape of the aperture opening 102 in housing 105 of module 100. In some embodiments, the particular shape and size of PCB 300 may differ from that explicitly shown in FIG. 3 such that it corresponds to the size and shape of an aperture opening in the housing of the particular module herein that houses the PCB. For example, the shape of the PCB may be configured to match the aperture in the housing that may be, for example, rectangular (or other) shaped.

In some embodiments, the red ("R"), green ("G"), and yellow ("Y") groups may be operated separately and exclusively of each other. That is, when the solid stated light sources of the red group are energized (i.e., "on") and operated to emit red light, then the solid state light sources of the green and yellow groups are not energized to emit green and yellow light, respectively. Likewise, the other groups are not operated to emit light when the green group and yellow group are individually and separately energized to emit light.

In some embodiments, the operation of the solid state light sources of FIG. 3 may be operated in combination with one or both of the power supplies 150 and 160 of FIG. 1. In some instances, one of the power supplies may be configured to provide a backup to the other power supply.

In some instances, the solid state light sources of the "R" group, "G" group, and "Y" group may alternately and selectively be energized and operated to emit, respectively, red, green, and yellow light from lighting fixture 100. By alternately and selectively be operated to emit either red, green, or yellow, the lighting fixture or module 100 may effectively and efficiently function as a signaling device. In accordance with some aspects herein, the optical output of the lighting fixture will be the same or similar for the lighting fixture 100 whether the color of the light emitted is red, green, or yellow so that the intensity and/or source of the light appears to be the same or similar notwithstanding the particular color being emitted from the device.

Figure 4:
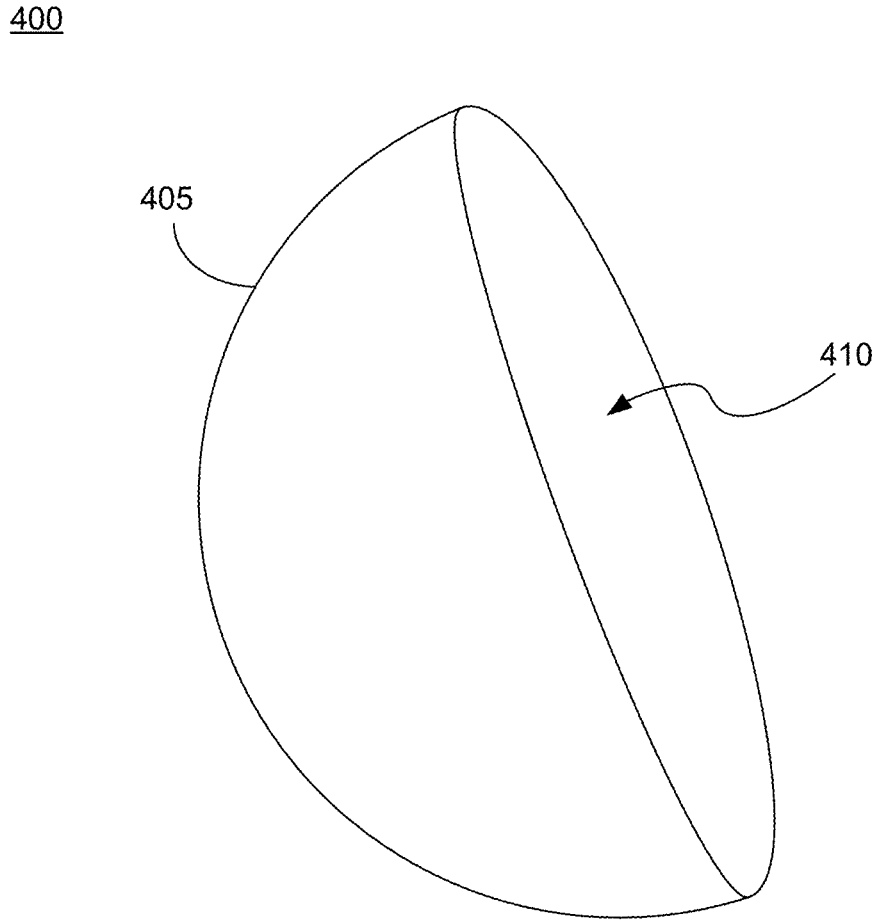
FIG. 4 is an illustrative depiction of semi-spherical backlit reflector, in accordance with some embodiments herein.

FIG. 4 is an illustrative depiction of a reflector 400, in accordance with some aspects and embodiments herein. In some aspects, reflector 400 has the shape of a half-sphere (i.e., semispherical). Reflector 400 has an outer surface and an inner surface 410. The inner surface 410 may be coated or constructed of a material, finish, texture, and combinations thereof that facilitate and in some instances improve an efficiency of the reflector with regards to reflecting light incident thereupon. In some aspects and embodiments, reflector 400 may be shaped and sized, at least in part, to accommodate the shape, size, and configuration of a PCB and the array of solid state light sources supported thereby. As shown in FIG. 1, reflector 112, PCB 140, the solid state light sources 115, 120, 125, 130 thereon, and lens 110 covering or occupying the aperture in the module's housing cooperate to form the mixing chamber within or internal to the module's housing.

In some aspects herein, reflector 400 is positioned and shaped to direct light reflecting from the inner surface 410 thereof towards the lens covering or occupying an aperture in the module's housing. In some embodiments, the reflected light may be focused by reflector 400 towards the lens covering or occupying the aperture in the module's housing aperture. In some embodiments, reflector 400 may be disposed on the lighting module's housing. In some embodiments, reflector 400 may be integral to the housing such that, for example, the outer surface of 405 forms a portion of the housing's outer surface.

In some embodiments, a diameter for a half-sphere configuration of a reflector herein may include diameters having the following values: 0.5 inch, 1.0 inch, 1.5 inch, 2.0 inch, and 2.5 inch. It should be appreciated however that ore dimensions are within the scope of the present disclosure as the examples provided herein are net intended to be exhaustive.

In some embodiments herein, the colors of the solid state light sources that may be used in a lighting module herein may include (1) red+mint, (2) red+yellow+and cyan, (3) warm white+cyan+red, (4) mint+blue+orange+far red, and (5) cool white+red. It is noted however that these are illustrative examples and other combinations of a plurality of solid state light sources may be implemented in accordance with various aspects of the present disclosure. In some aspects, the number of solid state light sources of a particular color may also be used to adjust or balance the light emitted from a LED module herein. It should be appreciated that the specific number of the specific colors of solid state light sources included in a particular embodiment herein may be varied depending on a desire output and/or application or use-case.

Figure 6:
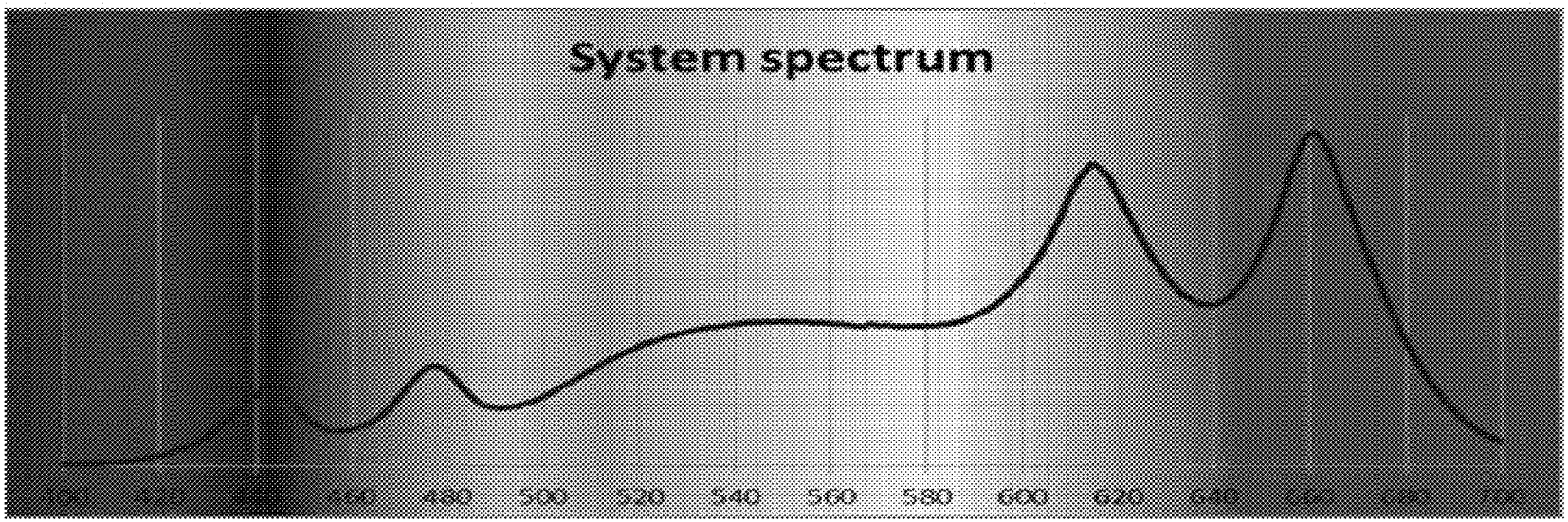
FIG. 6 is an illustrative spectrum plot for a lighting fixture, according to some embodiments herein.

FIG. 6 is an illustrative depiction of the balance spectrum 600 that may be achieved using a LED module as disclosed herein that includes solid state light sources that are mint, blue, orange, and far red.

Although embodiments have been described with respect to certain contexts, some embodiments may be associated with other types of devices, systems, and configurations, either in part or whole, without any loss of generality.

Embodiments have been described herein solely for the purpose of illustration. Persons skilled in the art will recognize from this description that embodiments are not limited to those described, but may be practiced with modifications and alterations limited only by the spirit and scope of the appended claims.

What is claimed is:

1. A lighting system comprising:

a housing defining an enclosure and having an aperture in an exterior surface of the housing, and further comprising a colored lens positioned to cover at least a portion of the aperture, the colored lens being red, green, or yellow;

a reflector being disposed on or in the enclosure of the housing to reflect light emissions;

a plurality of groups of solid state light sources disposed within the housing, each group including one or more solid state lighting sources configured to direct light emissions therefrom towards the reflector and each group of the plurality of solid state light sources operate to emit light separately of the other groups of solid state light sources; and a mixing chamber defined by a space within the enclosure located between the reflector and the aperture, the reflector being configured to reflect light emissions from the plurality of groups of solid state light sources towards the mixing chamber where the reflected light emissions are to combine before exiting the housing through the aperture, the combined light emissions replicating an optical intensity spectrum of light produced by a white incandescent lighting fixture and exiting the housing through the aperture having a uniformity of optical characteristics across the aperture for each of the plurality of groups of solid state light sources;

wherein the plurality of groups of solid state light sources comprises at least a primary group and a secondary group, the secondary group configured to be powered by a battery backup power supply in the event of a failure of one or more solid state light sources of the primary group and/or a failure of a mains power system;

wherein the lighting system is part of a railroad signal or a traffic signal.

2. The system of claim 1, wherein the solid state light sources comprise a light emitting diode.

3. The system of claim 1, wherein the lens is light transmissive.

4. The system of claim 1, wherein the concave reflector comprises a hemispherical shape.

5. The system of claim 1, wherein the plurality of solid state light sources comprise an array of light sources disposed along a periphery of the aperture oriented to emit light towards the reflector.

6. The system of claim 1, wherein the concave reflector on the housing is integral to the housing.

7. The system of claim 1, wherein one of the plurality of groups of solid state light sources is to emit light exclusive of the other groups of the solid state light sources at a given time.

8. The system of claim 1, wherein more than fifty percent of the light emissions from the plurality of solid state light sources is reflected by the reflector multiple times before exiting the housing through the aperture.

9. A railroad signal comprising the lighting system of claim 1.

10. A lighting system comprising:

a housing defining an enclosure and having an aperture in an exterior surface of the housing, and further comprising a colored lens positioned to cover at least a portion of the aperture, the colored lens being red, green, or yellow;

a reflector being disposed on or in the enclosure of the housing to reflect light emissions;

a plurality of groups of solid state light sources disposed within the housing, each group including one or more solid state lighting sources having a same optical color output configured to direct light emissions therefrom towards the reflector and each group of the plurality of solid state light sources operate to emit light separately of the other groups of solid state light sources; and a mixing chamber defined by a space within the enclosure located between the reflector and the aperture, the reflector being configured to reflect light emissions from the plurality of groups of solid state light sources towards the mixing chamber where the reflected light emissions are to combine before exiting the housing through the aperture, the combined light emissions replicating an optical intensity spectrum of light produced by a white incandescent lighting fixture and exiting the housing through the aperture having a uniformity of optical characteristics across the aperture for each of the plurality of groups of solid state light sources;

wherein the plurality of groups of solid state light sources comprises at least a primary group and a secondary group, the secondary group configured to be powered by a battery backup power supply in the event of a failure of one or more solid state light sources of the primary group and/or a failure of a mains power system;

wherein the lighting system is part of a railroad signal or a traffic signal.

11. The system of claim 10, wherein the solid state light sources comprise a light emitting diode.

12. The system of claim 10, wherein the lens is light transmissive.

13. The system of claim 10, wherein the concave reflector comprises a hemispherical shape.

14. The system of claim 10, wherein the plurality of solid state light sources comprise an array of light sources disposed along a periphery of the aperture oriented to emit light towards the reflector.

15. The system of claim 10, wherein the plurality of groups of solid state light sources comprises a group of red solid state light sources, a group of green solid state light sources, and a group of blue solid state light sources.

16. The system of claim 10, wherein the concave reflector on the housing is integral to the housing.

17. The system of claim 10, wherein one of the plurality of groups of solid state light sources is to exclusively emit light at a time.

18. The system of claim 10, wherein more than fifty percent of the light emissions from the plurality of solid state light sources is reflected by the reflector multiple times before exiting the housing through the aperture.

19. The system of claim 10, wherein an area including the aperture is within a surface including the solid state light sources.

* * * * *